US005507709A

United States Patent [19]

Wu

[11] Patent Number: 5,507,709

[45] Date of Patent: Apr. 16, 1996

[54] ROWING EXERCISE DEVICE

[76] Inventor: Tien-Lai Wu, 58, Ma Yuan West St., Taichung, Taiwan

[21] Appl. No.: 390,307

[22] Filed: Jan. 3, 1995

[51] Int. Cl.[6] ..... A63B 21/00

[52] U.S. Cl. ..... 482/72; 482/95; 482/96

[58] Field of Search ..... 482/72, 95, 57, 482/71, 96, 130, 135–137; 472/106, 110

[56] References Cited

U.S. PATENT DOCUMENTS

| | | | |
|---|---|---|---|
| 2,642,288 | 6/1953 | Bell | 482/72 |
| 3,446,503 | 5/1969 | Lawton | 482/72 |
| 4,743,010 | 5/1988 | Geraci | 482/72 |
| 5,135,456 | 8/1992 | Jones | 482/72 |
| 5,156,650 | 10/1992 | Bals | 482/57 |
| 5,299,997 | 4/1994 | Chen | 482/96 |
| 5,342,269 | 8/1994 | Huang et al. | 482/95 |
| 5,366,428 | 11/1994 | Liao | 482/96 |
| 5,370,594 | 12/1994 | Grinblat | 482/72 |

*Primary Examiner*—Jerome Donnelly

[57] ABSTRACT

An exercise device includes a bar, a handle and a seat post pivotally coupled to the front portion, the middle portion and the rear portion of a base. A foot support is disposed on top of the bar. A seat cushion is disposed on top of the seat post for supporting the users. A rod includes a front end pivotally coupled to the bar and a rear end coupled to the seat post. When the handle is pushed forward, the seat cushion may move downward. The users have to force against the gravity force of the users when the handle is pulled rearward.

1 Claim, 4 Drawing Sheets

ROWING EXERCISE DEVICE

BACKGROUND OF THE INVENTION

1. Field of the Invention

The present invention relates to an exercise device, and more particularly to a rowing exercise device.

2. Description of the Prior Art

Typical rowing type exercise devices comprise a pair of handles movable in a rowing type movement. Additional actuators are secured to the handles for providing resistance force against the handles.

The present invention has arisen to mitigate and/or obviate the afore-described disadvantages of the conventional exercise devices.

SUMMARY OF THE INVENTION

The primary objective of the present invention is to provide a rowing type exercise device in which no actuators are required to provide resistance force.

In accordance with one aspect of the invention, there is provided an exercise device comprising a base, a bar including a lower portion pivotally coupled to the front portion of the base and including an upper portion having a foot support means provided thereon, seat post means including a lower portion pivotally coupled to the rear portion of the base and including an upper portion having a seat cushion means provided thereon, handle means including a lower portion pivotally coupled to the middle portion of the base and including a bottom end portion, a rod disposed above the base and including a front end pivotally coupled to the bar so as to rotate the bar clockwise when the rod moves forward and so as to rotate the bar counterclockwise when the rod moves rearward, including a middle portion pivotally coupled to the bottom end portion of the handle means so as to rotate the handle means counterclockwise when the rod moves forward and so as to rotate the handle means clockwise when the rod moves rearward, and including a rear end, and lever means coupling the rear end of the rod to the seat post means so as to rotate the seat post means counterclockwise when the rod moves forward and so as to rotate the seat post means clockwise when the rod moves rearward.

The bar includes a lug secured thereto and having a plurality of holes formed therein, the front end of the rod is coupled to any of the holes.

The base includes a column extended upward from the rear portion thereof, the lever means includes a lever having a middle portion pivotally secured to the column and having a lower portion pivotally coupled to the rear end of the rod, the lever includes an upper end, and the lever means includes a link having a first end pivotally coupled to the upper end of the lever and having a second end pivotally coupled to the seat post means so as to couple the seat post means to the rod.

The base includes stop means disposed beside the lower portion of the seat post means for engaging with the seat post means so as to limit rotational movement of the seat post means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
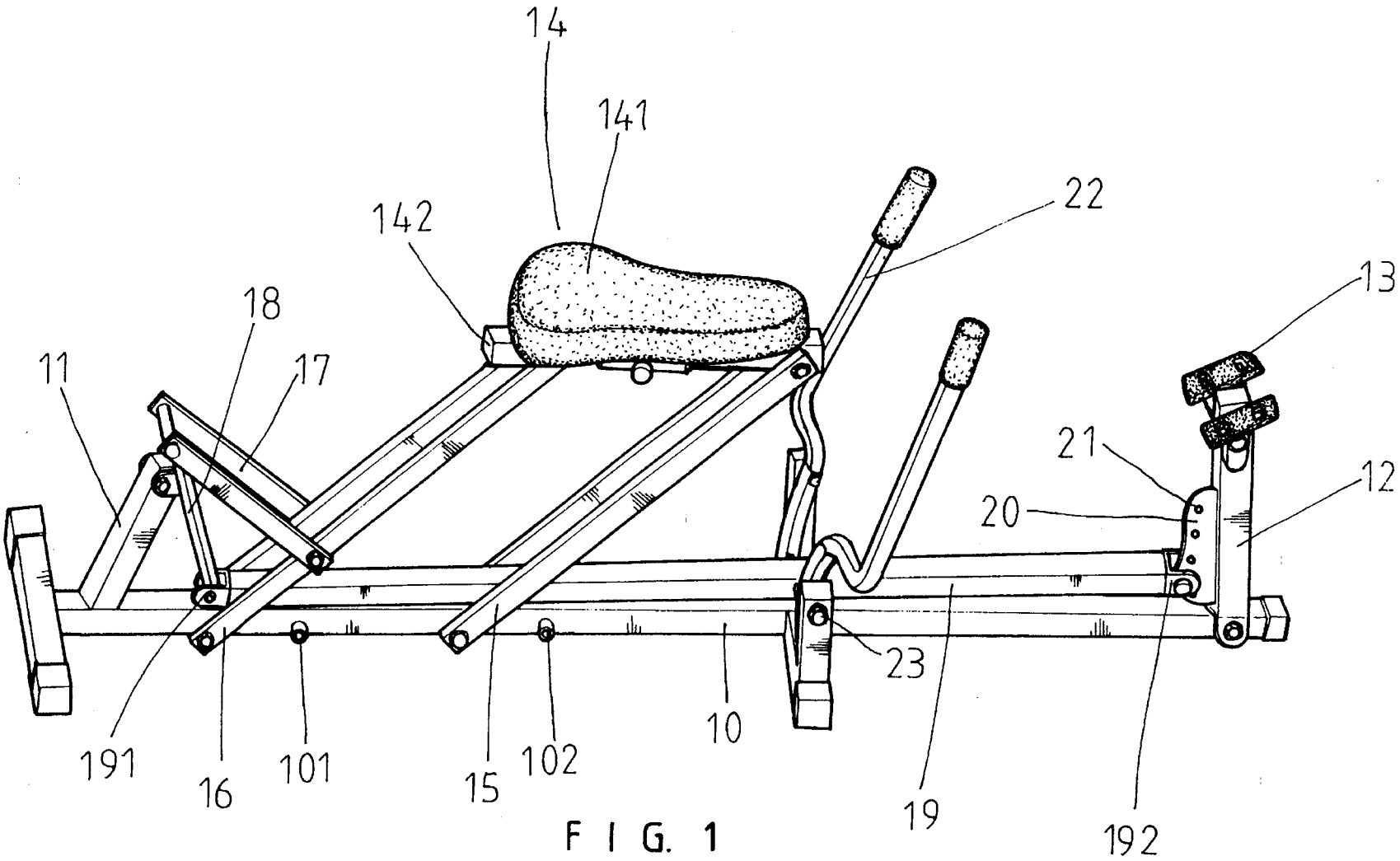
FIGS. 1, 2, 3, 4 are perspective views of a rowing exercise device, illustrating the operations of the rowing exercise device.
Figure 2:
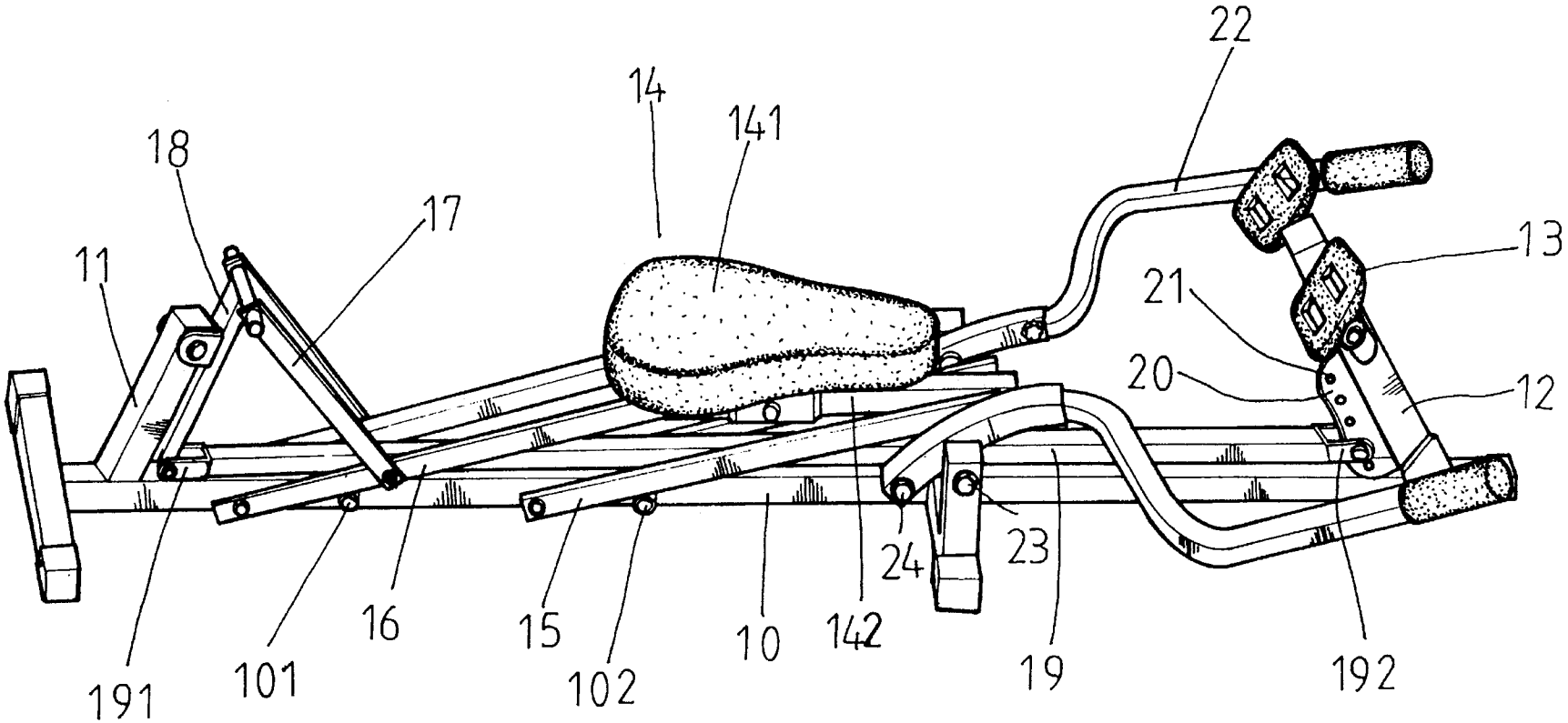

Referring to the drawings, and initially to FIGS. 1 and 2, a rowing exercise device in accordance with the present invention comprises a base 10 including a column 11 extended upward from the rear portion. A bar 12 includes a lower portion pivotally coupled to the base 10 and includes a pair of foot pedals 13 provided on top thereof. The bar 12 includes a lug 20 provided on the rear portion and having a number of holes 21 formed therein. Two pairs of seat posts 15, 16 include a lower portion pivotally coupled to the base 10 and include a seat device 14 pivotally coupled between the upper portion thereof. The seat device 14 includes a seat support 142 having a seat cushion 141 supported thereon. It is preferable that the seat cushion 141 may be adjusted forward and rearward relative to the seat support 142. Two stops 101, 102 are secured to the base 10 and located in front of the lower portions of the seat posts 15, 16 for engaging with the seat posts 15, 16 (FIG. 2) so as to limit rotational movement of the seat posts 15, 16.

A lever 18 includes a middle portion pivotally coupled to the upper end of the column 11 and includes an upper end pivotally coupled to the seat post 16 by a pair of links 17 such that the rotational movement of the seat post 16 may cause the lever 18 to rotate about the middle portion thereof. A rod 19 is disposed above the base 10 and includes a coupler 191 pivotally coupling the rear end of the rod 19 to the lower end of the lever 18 and includes another coupler 192 pivotally coupling the front end of the rod 19 to the lug 20. The coupler 192 may be engaged with either of the holes 21 such that the coupler 192 may be adjusted upward and downward along the flange 20. A pair of handles 22 include a lower portion pivotally coupled to the base 10 at a pivot axle 23 and include a bottom end pivotally coupled to the rod 19 at a second pivot axle 24 such that the rowing type movement of the handles 22 may cause the rod 19 to move forward or rearward.

Figure 3:
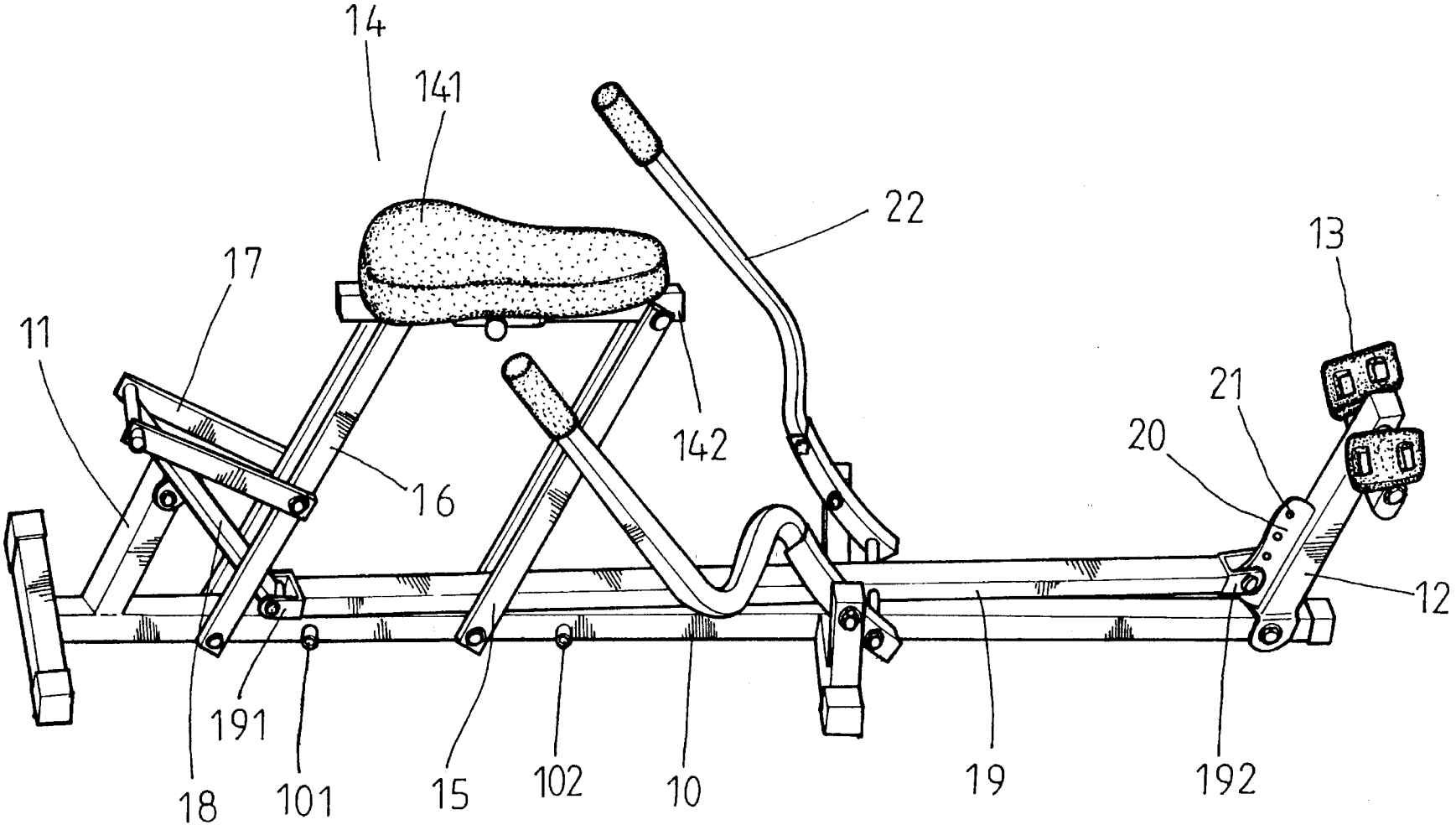
Figure 4:
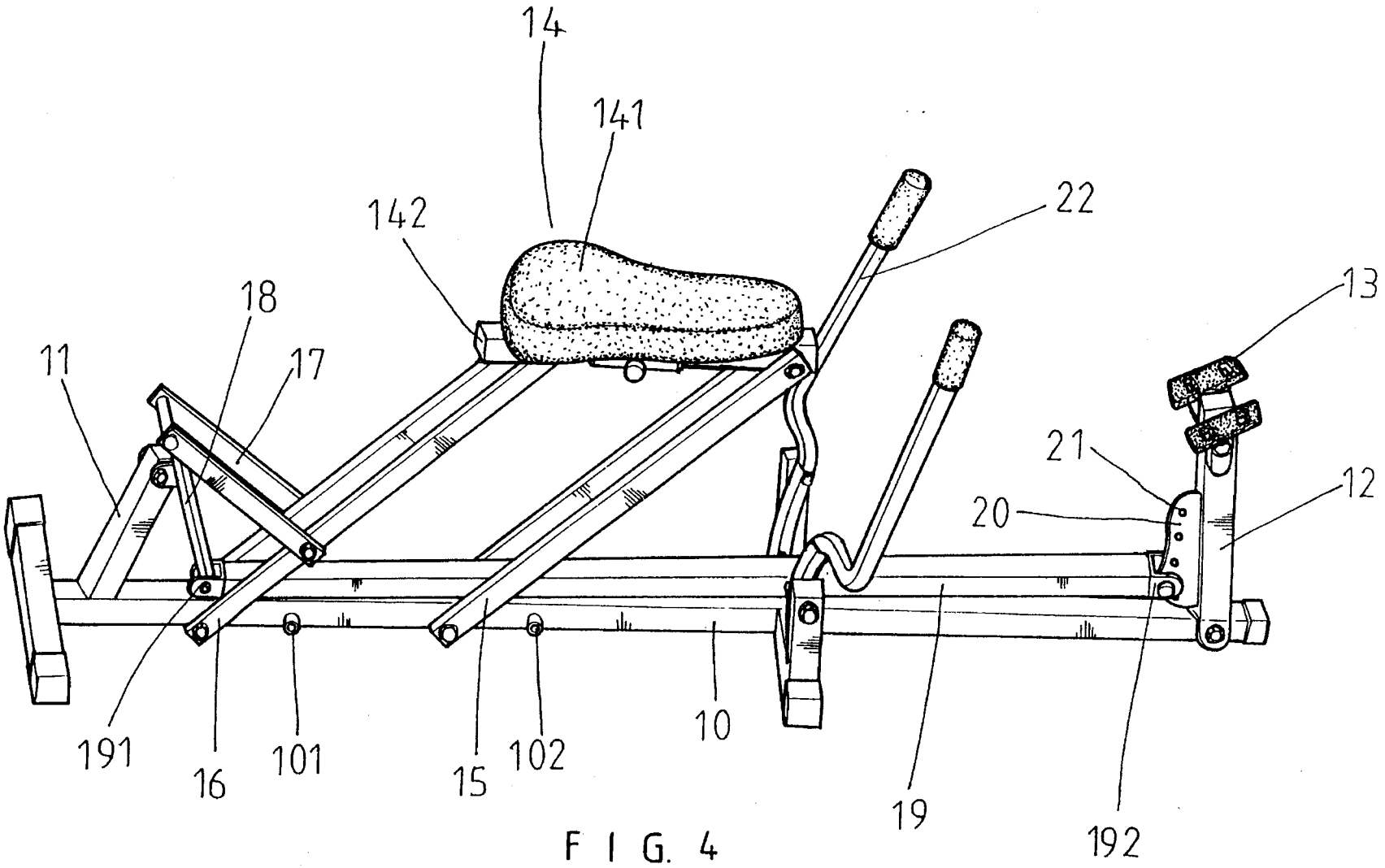

In operation, as shown in FIGS. 3 and 4, when the handles 22 are pushed forward by the user and are moved from the position as shown in FIG. 3 to the position as shown in FIG. 4, the rod 19 is caused to move rearward by the handles 22, and the bar 12 is thus caused to rotate counterclockwise. At this moment, the lever 18 is caused to rotate clockwise so as to rotate the seat posts 16 clockwise until the seat posts 15, 16 contact the stops 101, 102. On the contrary, when the handles 22 are pulled rearward, the rod 19 is caused to move forward by the handles 22, and the bar 12 is thus caused to rotate clockwise. At this moment, the lever 18 is caused to rotate counterclockwise so as to rotate the seat posts 16 counterclockwise and so as to move the seat cushion 141 upward. The users have to pull the handles 22 against the gravity force of the users applied onto the seat cushion 141 such that no actuators are required for the exercise devices.

Accordingly, the rowing exercise device includes a configuration without actuators, the weight of the users are provided for forming the resistance force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise device comprising:

a base including a front portion, a middle portion and a rear portion, a bar including a lower portion pivotally coupled to said front portion of said base and including an upper portion having a foot support means provided thereon, seat post means including a lower portion pivotally coupled to said rear portion of said base and including an upper portion having a seat cushion means provided thereon, handle means including a lower portion pivotally coupled to said middle portion of said base and including a bottom end portion, a rod disposed above said base and including a front end pivotally coupled to said bar so as to rotate said bar clockwise when said rod moves forward and so as to rotate said bar counterclockwise when said rod moves rearward, said rod further including a middle portion pivotally coupled to said bottom end portion of said handle means so as to rotate said handle means counterclockwise when said rod moves forward and so as to rotate said handle means clockwise when said rod moves rearward, and said rod including a rear end, lever means coupling said rear end of said rod to said seat post means so as to rotate said seat post means counterclockwise when said rod moves forward and so as to rotate said seat post means clockwise when said rod moves rearward, said bar including a lug secured thereto and having a plurality of holes formed therein, said front end of said rod coupled to any of said holes, said base including a column extended upward from said rear portion thereof, said lever means including a lever having a middle portion pivotally secured to said column and having a lower portion pivotally coupled to said rear end of said rod, said lever including an upper end, and said lever means including a link having a first end pivotally coupled to said upper end of said lever and having a second end pivotally coupled to said seat post means so as to couple said seat post means to said rod.

* * * * *